US005923309A

United States Patent [19]

Ishizuka et al.

[11] Patent Number: 5,923,309

[45] Date of Patent: Jul. 13, 1999

[54] DISPLAY DEVICE USING CURRENT DRIVEN TYPE LIGHT EMITTING ELEMENTS

[75] Inventors: Shinichi Ishizuka; Yoshiyuki Okuda; Hiroshi Ohata; Hideo Ochi, all of Tsurugashima, Japan

[73] Assignee: Pioneer Electronic Corporation, Tokyo, Japan

[21] Appl. No.: 08/853,890

[22] Filed: May 9, 1997

[30] Foreign Application Priority Data

May 15, 1996 [JP] Japan ..... 8-144964

[51] Int. Cl.[6] ..... G09G 3/32

[52] U.S. Cl. ..... 345/82; 345/77; 345/147

[58] Field of Search ..... 345/74, 75, 76, 345/77, 78, 79, 80, 81, 82, 83, 84, 85, 44, 45, 46, 147, 148, 150; 315/169.1, 169.3

[56] References Cited

U.S. PATENT DOCUMENTS 4,897,639 1/1990 Kanayama ..... 345/82

5,184,114 2/1993 Brown ..... 345/150

5,719,589 2/1998 Norman et al. ..... 345/82

*Primary Examiner*—Xiao Wu

*Attorney, Agent, or Firm*—Perman & Green, LLP

[57] ABSTRACT

A display device having light-emitting elements capable of maintaining high display quality without variation in emission comprises a display part having a plurality of light-emitting elements for emitting light at emission intensity in accordance with the amount of an input current, a reference table for storing control information associated with the amount of a driving current for each of the light-emitting elements, a driver for driving each of the light-emittlng elements of the display part by means of an electrical current, and a controller for controlling the amount of the driving current from the driver, the controller identifying control information associated with light-emitting elements to be driven for emiseion from the reference table and varies the amount of the driving current from the driver.

20 Claims, 8 Drawing Sheets

DISPLAY DEVICE USING CURRENT DRIVEN TYPE LIGHT EMITTING ELEMENTS

BACKGROUND OF THE INVENTION

1. Field of the Invention

The present invention relates to display devices and, more particularly, to a display device utilizing current-driven type light-emitting elements.

2. Description of Related Art

Organic electro-luminescence elements (hereinafter referred to as "organic EL elements") have been conventionally known in which a current is applied to luminescent elements formed on a glass plate or a transparent organic film to drive them for emission.

The configuration of a display device can be simplified by configuring it such that a common part of such organic EL elements is displayed in the form of a matrix as a single display portion.

When organic EL elements as described above are used as light-emitting elements, since the light-emitting element have different display areas, an element with a larger display area has a lower current density per unit area and hence lower emission intensity than those of an element with a smaller display area.

This results in a problem in that variation occurs in emission of light when a plurality of elements are simultaneously driven for emission, which disallows emission display to be performed with visually uniform brightness.

Especially, when a matrix is formed by connecting a plurality of light-emitting elements to one electrode line, although the intensity of the light-emitting elements can be made uniform by connecting light-emitting elements having the same area to the same anode line and setting the amount of the current for each anode line so an to achieve uniform emission intensity, this approach is limited in various ways and is not practical.

OBJECT AND SUMMARY OF THE INVENTION

The present invention has been conceived taking the above-described problems into consideration, and it is an object of the present invention to provide a display device having light-emitting elements capable of maintaining high display quality without variation in emission of light.

According to a first aspect of the invention, in a display device comprising a display means having a plurality of light-emitting elements which emit light with emission intensity in accordance with the amount of an input current, a reference table for storing control information associated with the amount of a driving current for each light-emitting element, a driving means for driving each of the light-emitting elements of the display means by an electrical current, and a control means for controlling the amount of the driving current of the driving means, the control means varies the amount of the driving current of the driving means by identifying the control information associated with to light-emitting elements to be driven for emission based on a drive command.

According to a second aspect of the invention, in the display device as described above, the driving means includes a plurality of current sources having different driving current values and the control means performs control such that at least one of the plurality of current sources is selected in association with each of the light-emitting elements based on the control information.

According to a third aspect of the invention, in the display device as described above, the plurality of current sources comprises one reference value and either of a value which is $2^n$ times the reference value or a value which is $2^{1/n}$ times the reference value (n=0, 1, 2, . . . ).

According to a fourth aspect of the invention, in any of the display devices as described above, the control means sets driving time of the driving means in association with each of the light-emitting elements based on the control information.

According to a fifth aspect of the invention, in any of the display devices as described above, the plurality of light-emitting elements comprise organic electro-luminescence elements.

With the configuration of the present invention as above-described, in even a display device wherein a plurality of light-emitting elements formed in various patterns having different light-emitting areas are provided on the same display panel, each of the light-emitting elements is driven by a current in an amount corresponding to the light-emitting area thereof and is driven for emission for display with visually uniform brightness without any variation in emission.

DETAILED DESCRIPTION OF PREFERRED EMBODIMENTS

Prior to the description of preferred embodiments of the present invention, a description will be made with reference to the accompanying drawings on an example of a conventional organic electro-luminesacenoe element.

Figure 1:
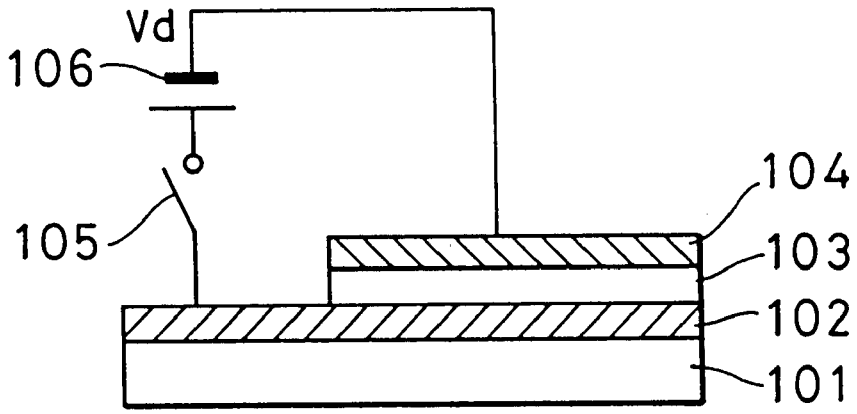
FIG. 1 is a diagram illustrating a simplified configuration of a conventional organic EL element.

FIG. 1 illustrates a simplified configuration of such an organic EL element. In FIG. 1, a transparent electrode 102 is formed on an upper surface of a glass substrate 101, and an organic layer 103 is formed on an upper surface of the transparent electrode 102. The organic layer is a lamination of plural kinds of substances, major components being organic substances. It is considered that luminescence occurs in a part of the lamination or at boundaries between the layers. Further, a metal electrode 104 is formed on an upper surface of the organic layer 103 as described above.

In the organic EL element having such a configuration, a switch 105 is switched from an off-state to an on-state to apply a DC emission driving voltage Vd output by a driving source 106 between the transparent electrode 102 and the metal electrode 104 and to thereby causes a flow of a current which produces excitons in the organic layer 103. Luminescence occurs when the excitons radiate to be deactivated and the light is emitted to the outside through the transparent electrode 102 and the glass substrate 101. Further switching of the switch 105 from the on-state to the off-state stops the application of the emission driving voltage Vd as described above and, as a result, emission as described above stops.

Figure 2:
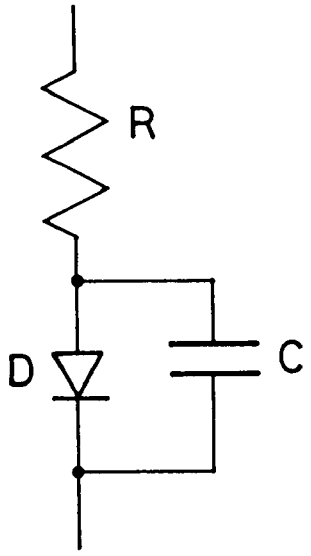
FIG. 2 is an electrical circuit diagram equivalently representing the conventional organic element.

FIG. 2 is an electrical circuit diagram equivalently representing the organic EL element. In general, as shown in FIG. 2, an organic EL element is thought to be a capacitive luminescent element which can be equivalently represented by a circuit resistance component R, a capacity component C, and a diode component D.

Therefore, when an emission driving voltage is applied to the organic EL element, an electrical charge corresponding to the electrical capacity of the element flows into and is accumulated in the electrodes as a displacement current. When a predetermined voltage (barrier voltage) is exceeded thereafter, a current starts flowing from the electrodes to the organic layer, and it is thought that emission occurs in proportion to this current.

Therefore, the instantaneous emission intensity of the element is proportionate to the magnitude of a forward current introduced into the light-emitting component D, and the average luminescence intensity of the element in a predetermined period of time is determined by the total amount of the electrical charge introduced during the period for which the average is to be obtained, provided that quantum efficiency of the element is constant. In other words, the average emission intensity of the element comprises two parameters, i.e., the magnitude and duration of the applied current and is proportionate to a value which is the time integral of the current applied to the element during the predetermined period of time, i.e., the amount of current.

Figure 3:
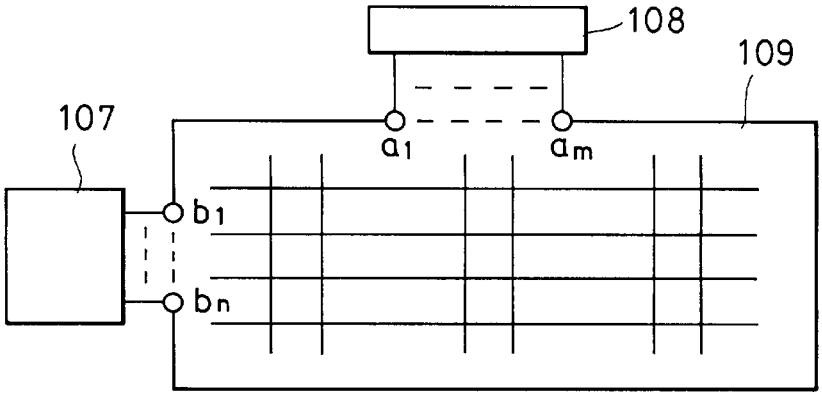
FIG. 3 is a diagram illustrating an example of a major part of a display device configured using the conventional organic EL elements as light-emitting elements.

FIG. 3 illustrates an example of a major part of a display device configured using such organic EL elements as light-emitting elements for display.

The display device comprises a cathode line scan circuit 107, an anode line drive circuit 108, and a display panel 109. Connection terminals $a_1$ through $a_m$ and $b_1$ through $b_n$ for connecting the cathode line scan circuit 107 and the anode line drive circuit 108 are provided at the display panel 109. The cathode line scan circuit 107 and the display panel 109 are connected through the connection terminals $b_1$ through $b_n$ which form a part of a connection portion, and the anode line drive circuit 108 and the display panel 109 are connected through the connection terminals $a_1$ through $a_m$ which also form a part of the connection portion.

Figure 4:
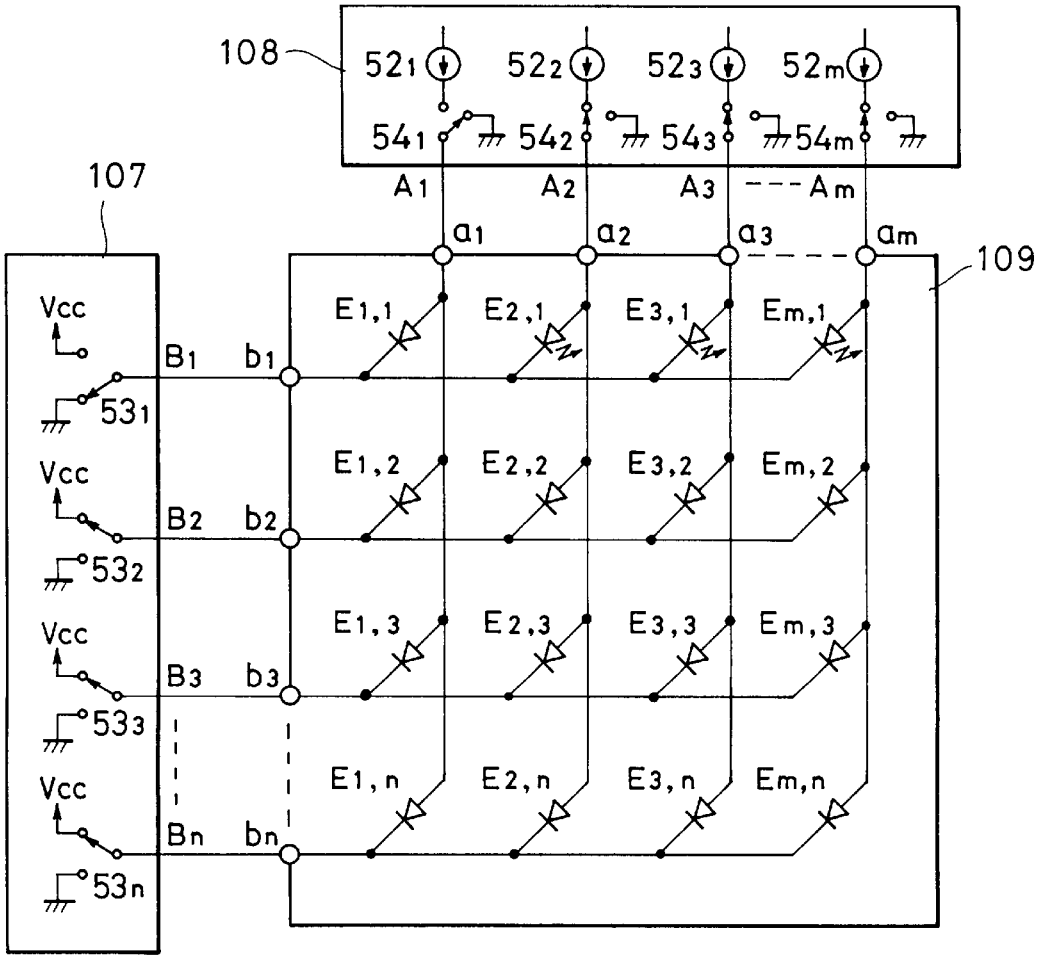
FIG. 4 is a diagram illustrating details of the major part of the conventional display device shown in FIG. 3.

FIG. 4 shows each part of the display device shown in FIG. 3 in detail. The driving method shown in FIG. 4 is that referred to as "simple matrix driving system". Anode lines $A_1$ through $A_m$ and cathode lines $B_1$ through $B_n$ are arranged in the form of a grid. Light-emitting elements $E_{1,1}$ through $E_{m,n}$ are connected in association with positions where the respective anode lines and cathode lines arranged in the form of a grid intersect with each other. Either the anode lines or cathode lines are sequentially selected and scanned at predetermined time intervals, and the other lines are driven by current sources $\mathbf{52}_1$ through $\mathbf{52}_m$ as driving sources in synchronism with the scanning. Thus, the light-emitting element corresponding to arbitrary intersecting position is driven for emission.

FIG. 4 illustrates an example of cathode line scanning, and anode line driving wherein the cathode line scan circuit 107 sequentially selects each cathode line, and selected cathode lines are connected to a ground potential. Meanwhile, the anode line drive circuit connects the elements to be driven for emission among the light-emitting elements connected to the selected cathode lines to the driving current sources to supply a current thereto.

FIG. 4 shows the operation of each part at the time of emission of the elements $E_{2,1}$, $E_{3,1}$, and $E_{m,1}$ wherein the cathode line B1 is selected to be connected to the ground potential and, simultaneously with this scanning process, the driving sources are connected to the anode lines $A_2$, $A_3$, and $A_m$ to drive the light-emitting elements for emission.

Referring to cathode lines other than the cathode lines being scanned, anode line driving is performed such that a reverse bias voltage Vcc at substantially the same potential that appears at the anodes of the elements being driven for emission to prevent them from emitting erroneously.

Figure 5:
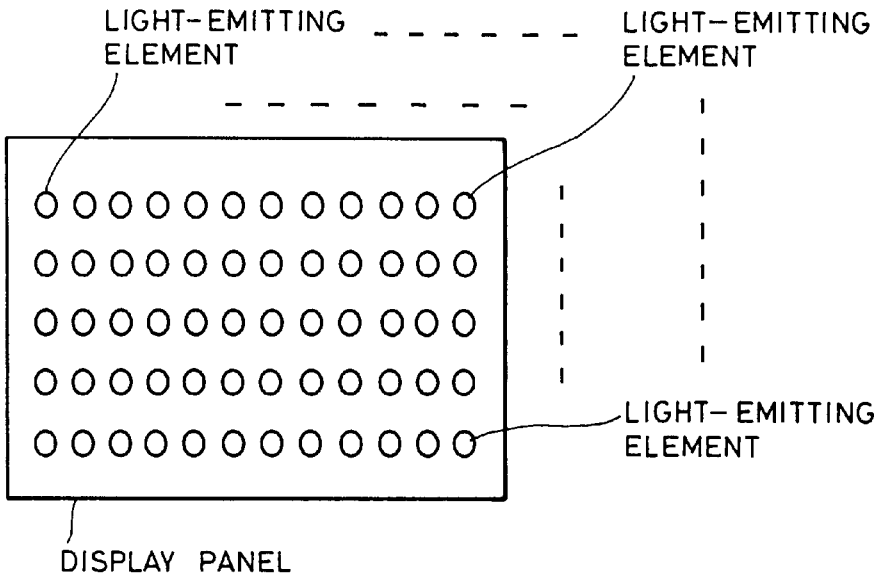
FIGS. 5 and 6 are diagrams illustrating an example of the arrangement of light-emitting elements on a display panel of a display device configured using conventional organic EL elements as light-emitting elements.
Figure 6:
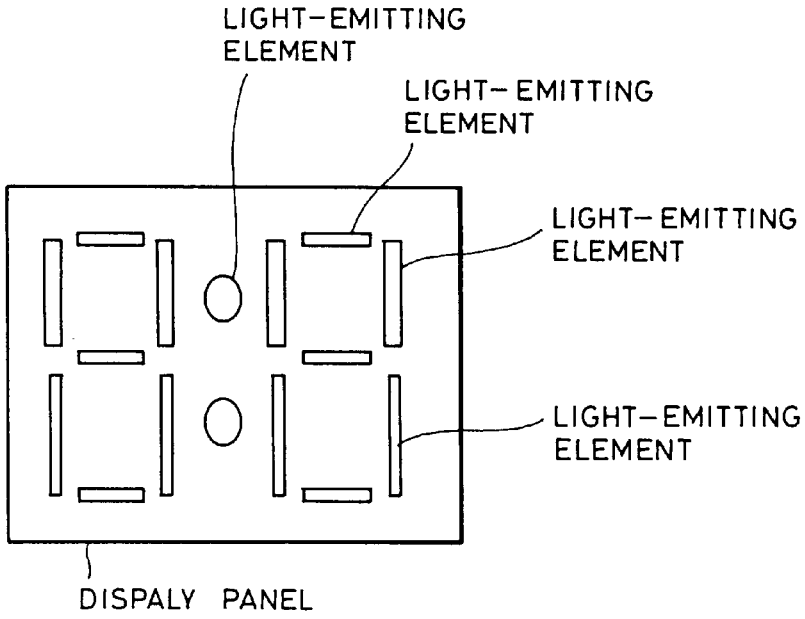

The display device as described above can be applied to various kinds of electronic equipment. For example, display can be performed in various ways by regularly arranging light-emitting elements having the same emitting area and shape in the form of a matrix as described above to configure a so-called dot matrix, as shown in FIG. 5. Further, as shown in FIG. 6. a commonly used portion may be configured and displayed as a single display portion to simplify the configuration of a display device.

In the latter case, however, when the organic EL elements as described above are used as light-emitting elements, since the display areas of the light-emitting elements are different, if the same driving current is applied to each light-emitting element, an element with a larger emitting area will have a lower current density per unit area and hence lower average emission intensity than those of an element with a smaller emitting area.

As a result, variation in emission occurs when a plurality of elements are driven for emission simultaneously, which leads to a problem in that emission display can not be performed with visually uniform brightness.

Especially, when a matrix is formed by connecting a plurality of light-emitting elements to one electrode line, although the intensity of the light-emitting elements can be made uniform by connecting light-emitting elements having the same area to the same anode line and setting the amount of the current for each anode line so as to achieve uniform emission intensity, this approach is limited in various ways and is not practical.

A preferred embodiment of the present invention will now be described with reference to FIGS. 7–9.

Figure 7:
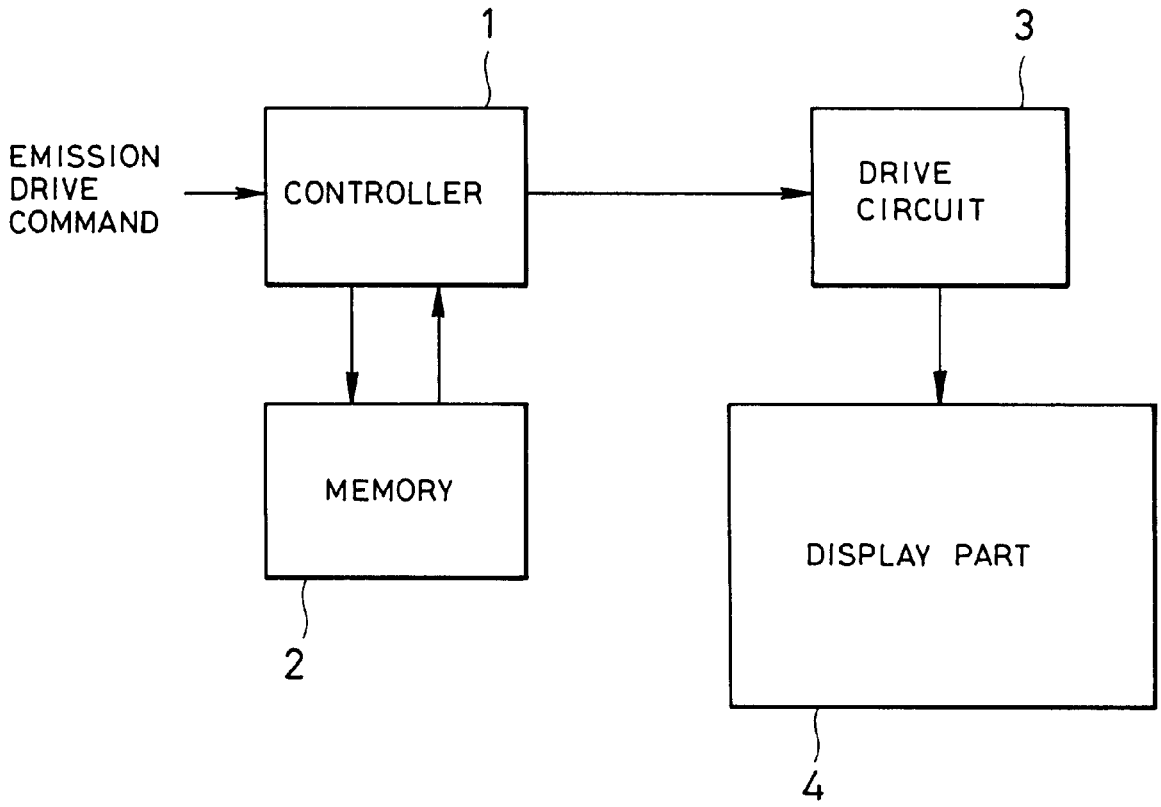
FIG. 7 is a simplified configuration block diagram of a display device according to an embodiment of the present invention.

FIG. 7 is a simplified configuration block diagram of a display device according to an embodiment of the present invention.

In FIG. 7, a controller 1 performs control such that one or a plurality of current sources are appropriately selected from among a plurality of current sources included in a drive circuit 3 of the display device based on control data stored in a memory 2 in advance according to an emission drive command and are connected to elements to be driven for emission among a plurality of light-emitting elements provided at a display part 4 to drive the light-emitting elements for emission.

A detailed description will now be given on the configuration of each part.

Figure 8:
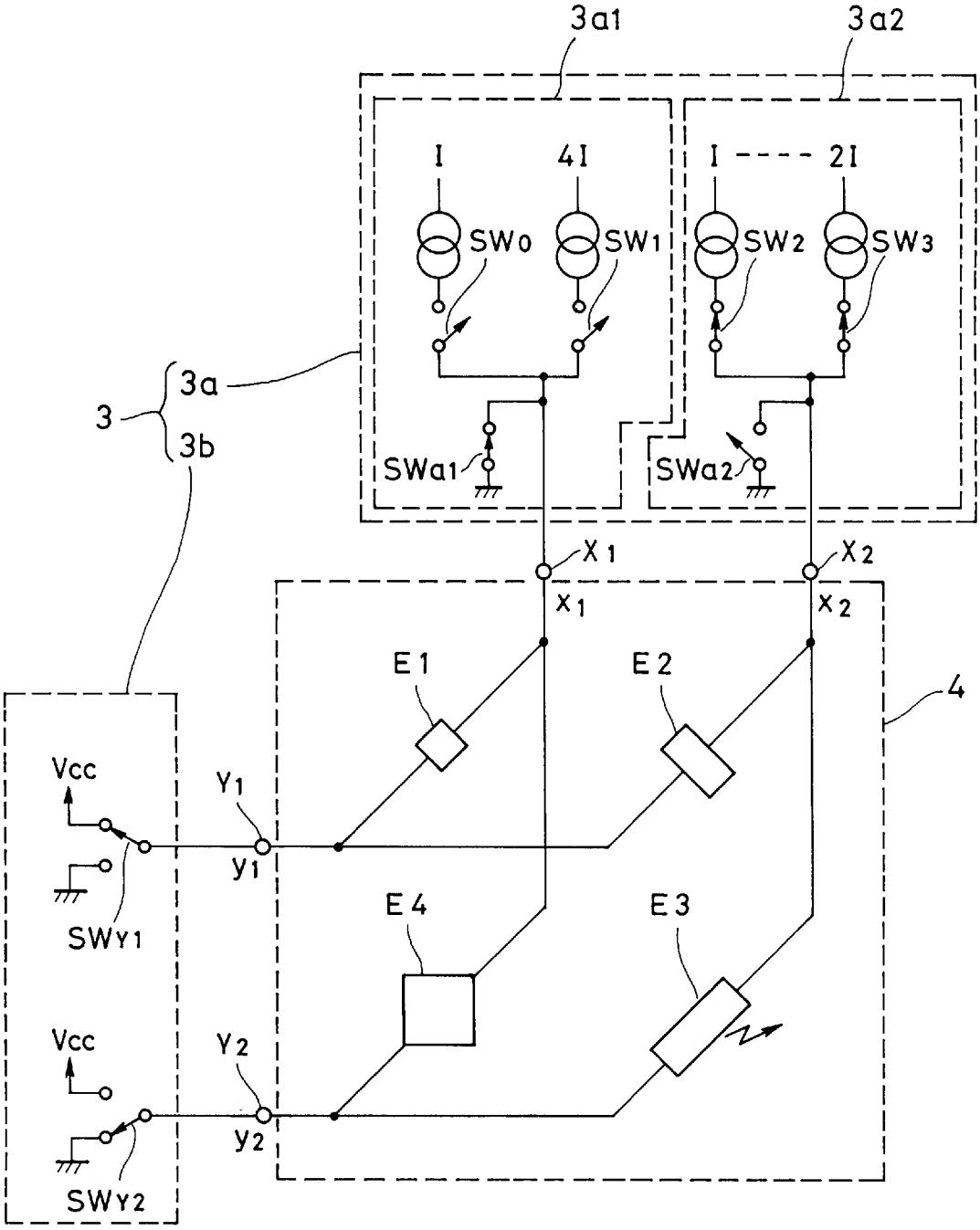
FIG. 8 is a diagram illustrating a configuration of a drive circuit and a display part of the display device according to the embodiment of the present invention.

FIG. 8 shows an example of the configuration of the drive circuit 3 and the display part 4 which is shown, for simplicity of the description, as a configuration wherein four light-emitting elements (E1–E4) are connected in the form of a 2×2 matrix. The anode of each element is connected to external terminals $X_1$ and $X_2$, and the cathode of each element is connected to external terminals $Y_1$ and $Y_2$. Further, the description will proceed on an assumption that the light-emitting elements have different patterns and the light-emitting elements E2, E3, and E4 are formed with emission display areas 2S (=2×S), 3S (=3×S), and 4S (=4×S), respectively, where S represents the emission display area of the light-emitting element E1.

The drive circuit 3 includes an anode line drive circuit 3*a* and a cathode line scan circuit 3*b*.

Anode lines $x_1$, $x_2$ and cathode lines $y_1$, $y_2$ are connected to the anode line drive circuit 3*a* and the cathode line scan circuit 3*b*, respectively, through the external terminals $X_1$, $X_2$ and $Y_1$, $Y_2$ of the display part 4.

The anode line drive circuit 3*a* includes an anode line drive circuit 3*a*1 and an anode line drive circuit $3a_2$ and a plurality of current sources having different drive current values (I, 2I (=2×I), and 4I (=4×I)). Each of the current sources can be connected to the anode lines $x_1$, $x_2$, of the display part 4 through any of a plurality of switches ($SW_0$, $SW_1$, $SW_2$, and $SW_3$) under control of the controller 1.

Further, switches $SWa_1$ and $SWa_2$ are connected to the anode lines $x_1$ and $x_2$ and are connected to the ground potential at the other ends thereof.

Further, the anode line scan circuit 3*b* includes a plurality of switches ($SW_{Y1}$, $SW_{Y2}$) which are controlled by the controller 1, and each of the switches is configured to allow selection between the ground and the reverse bias voltage Vcc. Switching scan is performed at predetermined time intervals such that the external terminals are sequentially grounded one at a time.

Figure 9:
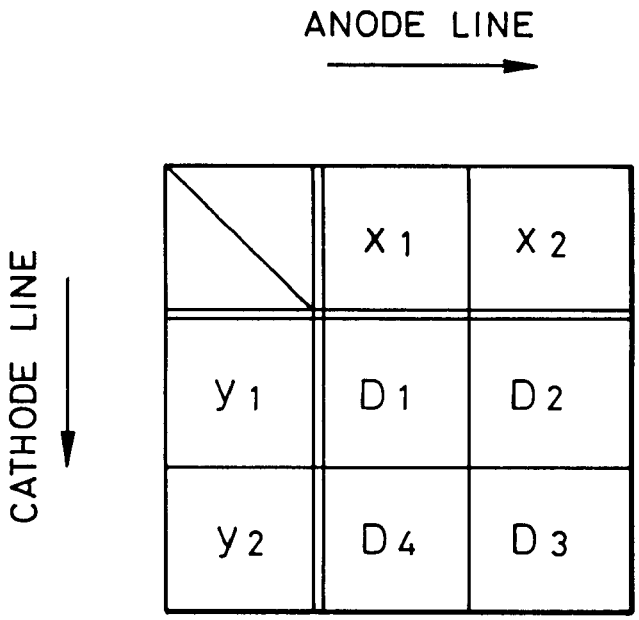
FIG. 9 is a reference table showing the contents of data stored in a memory of the display device according to the embodiment of the present invention.

FIG. 9 is an example of a reference table showing the contents of data stored in the memory 2.

The memory 2 comprises, for example, a memory element such as a ROM and stores area information (driving current information) associated with the display area of each of the light-emitting elements that form the display part 4 which has been converted into control data controllable by the controller 1. Specifically, as shown in FIG. 9, the memory 2 stores four items of control data ($D_1$–$D_4$) associated with the display areas of the four respective light-emitting elements (E1–E4) of the display part 4, the anode lines $x_1$, $x_2$ and the cathode lines $y_1$, $y_2$ connected to both electrodes of each light-emitting element serving as parameters.

The control data $D_1$–$D_4$ are data for controlling the light-emitting elements of the display part 4 such that no variation occurs in emission when one or a plurality of the elements are selected for emission. Based on a drive command, the controller 1 reads the relevant control data from the reference table to control the amount of current output by the drive circuit 3 in correspondence to the emitting area of each light-emitting element.

A description will now be made on a control operation performed by the controller 1 in response to a drive command to achieve emission display on the display part in accordance with the drive command.

First, referring to FIG. 8, when the controller 1 receives a drive command for driving, for example, the light-emitting element E3 of the display part 4 for emission for a predetermined period of time, it reads the control data associated with the light-emitting element E3 from the memory 2. The control data for the light-emitting element E3 is identified using the reference table shown in FIG. 9 and, in this case, control data D3 stored in association with the element E3 is selected.

Next, the controller 1 controls driving performed by the drive circuit 3 based on the control data $D_3$.

Specifically, the controller 1 controls the cathode line scan circuit 3*b* at timing for scanning, controls the switches $SW_{Y1}$ and $SW_{Y2}$ such that the switch $SW_{Y2}$ is set in the ground potential position and the switch $SW^{Y1}$ is set at the Vcc potential for the reverse bias driving, and controls such that the switches $SW_2$, $SW_3$, and $SWa_1$ of the anode line drive circuit are closed to cause a current at a value of 3I which is combined current values I and 2I to flow only through the light-emitting element E3, thereby driving the light-emitting element E3 for emission.

Further, when the controller 1 receives a drive command to drive the light-emitting element E1 for emission, it similarly acquires control data $D_1$ associated with the light-emitting element E1 from the reference table in the memory 2 and selects and controls each switch during a period in which the switch $SW_{Y1}$ on the cathode side of the light-emitting element E1 is connected to the ground potential as a result of scanning, thereby performing control so as to cause the current I to flow through the light-emitting element 1.

Furthermore, similar control is performed when the light-emitting elements E2 and E4 are driven for emission. Control is performed such that the current 2I flows through the light-emitting element E2 when the light-emitting element E2 is to be driven and such that the current 4I flows through the light-emitting element E4 when the light-emitting element E4 is to be driven.

A comparison of the current densities of the light-emitting elements indicates that the current density of the light-emitting element E1 is I/S because a current having the current value I flows therethrough, and the current density of the light-emitting element E2 is also I/S (=2I/2S) because a current having the current value 2I flows therethrough. Further, the current densities of the light-emitting elements E3 and E4 are also I/S, which means that no variation in emission occurs and emission with visually uniform intensity is achieved even if those light-emitting elements are driven for emission simultaneously.

In the present embodiment, for simplicity of the description, the display part 4 of the display device are configured using four organic EL elements having emission display surfaces which are integral multiples of each other. It goes without saying, however, that the number of the organic EL elements used, the display area of each organic EL element, and the current sources used may be arbitrarily set within the scope of the present invention.

Further, although the values of the driving currents are set such that the elements have the same current density (I/S) in the present embodiment, it is not essential to set exactly the same value, and it is possible to reduce the number of the current source used by setting allowance at which no visible variation occurs in emission.

Figure 10:
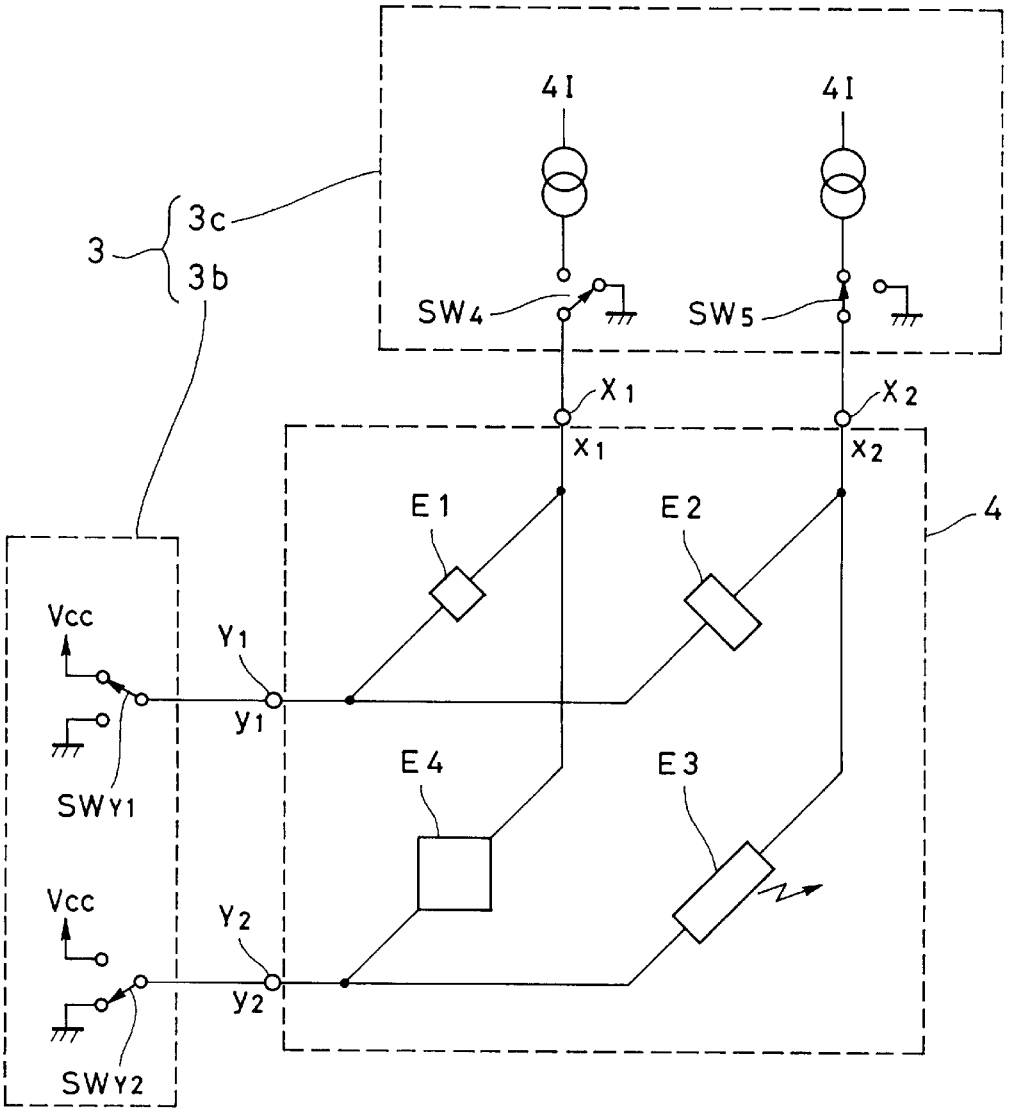
FIG. 10 is a diagram illustrating a configuration of a drive circuit and a display part of the display device according to another embodiment of the present invention.
Figure 11A:
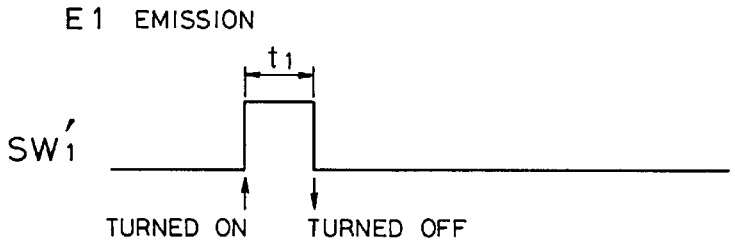
FIGS. 11A and 11B are timing charts according to which a switch connected to each anode line of the drive circuit of the display device in FIG. 10 is turned on and off by control commands from a controller.
Figure 11B:
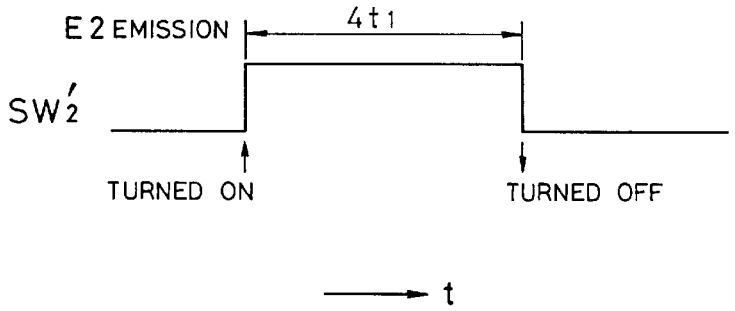

Further, it is not essential that the anode line drive circuit provides for switching between a plurality of current sources as shown in FIG. 8. For example, as shown in FIG. 10, the drive circuit 3 may be configured using an anode line drive circuit 3*c* having a configuration wherein a current source having the current value 4I is provided for each anode line and the connection between each current source and the corresponding anode lines $x_1$, $x_2$ can be switched on and off by switches $SW_4$ and $SW_5$, and the connection time of the current sources may be variably controlled by the controller 1 based on control data. In this case, for example, control may be performed such that the current source and the anode line $x_1$ are connected for time $t_1$ as shown in FIG. 11 to drive the light-emitting element E1 for emission and such that the current source and the anode line $x_1$ are connected for time $4t_1$ ($=4\times t_1$) to drive the light-emitting element E4 for emission to provide the same effect, thereby allowing the number of the used current sources to be reduced.

With the above-described configuration, the present invention allows each light-emitting element to be driven by a current in an amount corresponding to the emission area thereof even in a display device having a plurality of light-emitting elements formed in various patterns having different emission areas. As a result, the present invention allows emission display at visually uniform brightness without variation in emission to makes it possible to maintain high display quality and, therefore, can be applied especially to display device utilizing current-driven light-emitting elements such as organic EL elements with preferable results.

The present invention has been described above with reference to preferred embodiments thereof. It should be understood that various alterations and modifications may be contemplated by those skilled in the art. It is intended that all such alterations and modifications are included in the scope of the appended claims.

What is claimed is:

1. A display device comprising:

a display means having a plurality of light-emitting elements for emitting light at emission intensity in accordance with the amount of an input current;

a reference table for storing control information associated with the amount of a driving current for each of said light-emitting elements such that no variation occurs in emission intensity when one or a plurality of said light-emitting elements is selected for emission;

a drive means for driving each of the light-emitting elements of said display means by means of an electrical current; and a control means for controlling the amount of the driving current from said drive means, wherein said control means identifies control information associated with light-emitting elements to be driven for emission from said reference table and varies the amount of the driving current from said drive means so as to achieve a uniform emission intensity among all of said plurality of light-emitting elements.

2. The display device according to claim 1, wherein said drive means includes a plurality of current sources having different drive current values and wherein said control means performs control such that at least one of said plurality of current sources is selected in correspondence to each of said light-emitting elements based on said control information.

3. The display device according to claim 2, wherein said plurality of current sources are configured to have one reference value and either a value which is $2^n$ times said reference value or a value which is $2^{1/n}$ times said reference value (n=0, 1, 2, . . . ).

4. The display device according to claim 1, wherein said control means sets driving time of said drive means in association with each of said light-emitting elements based on said control information.

5. The display device according to claim 2, wherein said control means sets driving time of said drive means in association with each of said light-emitting elements based on said control information.

6. The display device according to claim 3, wherein said control means sets driving time of said drive means in association with each of said light-emitting elements based on said control information.

7. The display device according to claim 1, wherein said plurality of light-emitting elements comprise organic electro-luminescence elements.

8. The display device according to claim 2, wherein said plurality of light-emitting elements comprise organic electro-luminescence elements.

9. The display device according to claim 3, wherein said plurality of light-emitting elements comprise organic electro-luminescence elements.

10. The display device according to claim 4, wherein said plurality of light-emitting elements comprise organic electro-luminescence elements.

11. The display device according to claim 1, wherein said control information is determined based on an area of each light emitting-element, so as to maintain a uniform emission intensity among a plurality of light-emitting elements whose areas are different.

12. The display device according to claim 11, wherein said drive means includes a plurality of current sources having different drive current values and wherein said control means performs control such that at least one of said plurality of current sources is selected in correspondence to each of said light-emitting elements based on said control information.

13. The display device according to claim 12, wherein said plurality of current sources are configured to have one reference value and either a value which is $2^n$ times said reference value or a value which is $2^{1/n}$ times said reference value (n=0, 1, 2, . . . ).

14. The display device according to claim 11, wherein said control means sets driving time of said drive means in association with each of said light-emitting elements based on said control information.

15. The display device according to claim 12, wherein said control means sets driving time of said drive means in association with each of said light-emitting elements based on said control information.

16. The display device according to claim 13, wherein said control means sets driving time of said drive means in association with each of said light-emitting elements based on said control information.

17. The display device according to claim 11, wherein said plurality of light-emitting elements comprise organic electro-luminescence elements.

18. The display device according to claim 12, wherein said plurality of light-emitting elements comprise organic electro-luminescence elements.

19. The display device according to claim 13, wherein said plurality of light-emitting elements comprise organic electro-luminescence elements.

20. The display device according to claim 14, wherein said plurality of light-emitting elements comprise organic electro-luminescence elements.

* * * * *